US011592251B2

(12) United States Patent
Mihola

(10) Patent No.: US 11,592,251 B2
(45) Date of Patent: Feb. 28, 2023

(54) ASSEMBLY OF A BREECH, A BREECH BLOCK AND AN EJECTOR

(71) Applicant: Ceska Zbrojovka A.S., Uhersky Brod (CZ)

(72) Inventor: Martin Mihola, Banov (CZ)

(73) Assignee: Ceska Zbrojovka A.S., Uhersky Brod (CZ)

( * ) Notice: Subject to any disclaimer, the term of this patent is extended or adjusted under 35 U.S.C. 154(b) by 0 days.

(21) Appl. No.: 17/569,814

(22) Filed: Jan. 6, 2022

(65) Prior Publication Data

US 2022/0290938 A1 Sep. 15, 2022

(30) Foreign Application Priority Data

Jan. 8, 2021 (CZ) ..... CZ2021-4

(51) Int. Cl.
*F41A 15/16* (2006.01)
*F41A 15/14* (2006.01)

(52) U.S. Cl.
CPC ..... *F41A 15/16* (2013.01); *F41A 15/14* (2013.01)

(58) Field of Classification Search
CPC ..... F41A 15/12; F41A 15/14; F41A 15/16
See application file for complete search history.

(56) References Cited

U.S. PATENT DOCUMENTS 99,504 A * 2/1870 Theake ..... F41A 15/14 42/16
936,806 A * 10/1909 Pedersen ..... F41A 15/14 42/20
1,564,014 A * 12/1925 Johnd ..... F41A 15/14 42/25
3,745,686 A * 7/1973 Koon, Jr. ..... F41A 3/12 42/16

(Continued)

FOREIGN PATENT DOCUMENTS

EP 2017565 1/2009
EP 3514473 7/2019
FR 1073602 A * 9/1954 ..... F16J 9/16

(Continued)

OTHER PUBLICATIONS

Search Report dated Feb. 2, 2021 in Corresponding Application PV 2021-4 (3 pages).

*Primary Examiner* — Gabriel J. Klein
(74) *Attorney, Agent, or Firm* — Hovey Williams LLP

(57) ABSTRACT

An assembly of a breech (1), a breech block (2) and an ejector (3) wherein the breech (1) is connected to the breech block (2) with the use of a groove (10), arranged in the breech block (2), and a corresponding recess, arranged in the breech (1). An ejector (3) is arranged in the breech (1) that is longitudinally adjustable in a sliding way between the front and rear end position. The ejector (3) is biased by a spring (6) against the shooting direction. On the back of the ejector (3) a recess is arranged that a peg (7) that protrudes (Continued)

from the breech (1) reaches into. At the rear side of the ejector (3), a longitudinal pin (4) is arranged that fits into an opening (5) in the breech block (2) in the rear end position of the ejector (3). On the part of the ejector (3) that protrudes out of the breech (1), a stop surface (9) is arranged for bearing on the breech guide (11) that protrudes out of the breech (1) block.

1 Claim, 2 Drawing Sheets

(56) References Cited

U.S. PATENT DOCUMENTS

| | | | | |
|---|---|---|---|---|
| 2002/0026739 | A1* | 3/2002 | Murello ..... | F41A 15/14<br>42/47 |
| 2004/0055198 | A1* | 3/2004 | Gussalli Beretta ..... | F41A 15/14<br>42/46 |

FOREIGN PATENT DOCUMENTS

| | | |
|---|---|---|
| WO | 2014031410 | 2/2014 |
| WO | 20190506037 | 3/2019 |

* cited by examiner

ASSEMBLY OF A BREECH, A BREECH BLOCK AND AN EJECTOR

RELATED APPLICATIONS

This application claims the priority benefit of Czech Patent Application Serial No. PV2021-4 entitled "An assembly of a breech, a breech block and an ejector," filed Jan. 8, 2021, the entire disclosure of which is incorporated herein by reference.

TECHNICAL FIELD

The invention relates to an assembly of a breech, a breech block and an ejector wherein the breech is connected to the breech block with the use of a groove, arranged in the breech block, and a corresponding recess, arranged in the breech, wherein an ejector is arranged in the breech that is longitudinally adjustable in a sliding way between the front and rear end position, and the ejector is biased by a spring against the shooting direction, and on the back of the ejector a recess is arranged that a peg that protrudes from the breech reaches into.

PRIOR ART

In firearms, the breech must be locked in the breech block to prevent it from undesirably falling out. A breech is a replaceable locking member that rotates around its axis to lock the cartridge in the cartridge chamber. A breech block is the carrier of the breech that rotates the breech. The breech is connected to the breech block by means of a T-groove in the breech block and a corresponding recess in the breech. The parts are protected from undesirably falling out by an ejector mounted in the breech.

The document WO2014031410 describes an assembly of a breech for a firearm as a self-loading or pellet shotgun that comprises a breech block, a breech carrier and a breech head. The breech head is seated in the breech block and is rotatable inside the breech block to ensure locking of the breech assembly before a shot from the gun, but does not protrude out of the breech block during such a rotation. The breech carrier moves axially with respect to the breech body to ensure rotation of the breech head. An ejector can be rotatably connected to the breech block while the ejector can be integrated in the breech assembly to grasp and eject the cartridge case after the shot.

The document EP3514473 describes a top assembly of a receiver and a barrel that comprises a top receiver, a barrel assembly and a gas piston assembly. The top casing of the receiver is adapted for insertion of a shotgun cartridge case and the breech carrier assembly comprises a breech carrier, a breech in the carrier, a striker and an ejector to eject cartridge cases. The barrel assembly mainly comprises a barrel, a barrel extension and a barrel nut to attach the barrel and the barrel extension to the top casing of the receiver. The gas piston assembly is adapted for coaxial mounting along the barrel and comprises a piston body, a piston end lid and a piston cover arranged to receive the piston lid in a sliding way. The barrel has a gas port that connects the opened hole of the barrel to the piston gap. A tensioning member pushes the piston towards the cover.

The prior-art ways of locking are generally ensured by means of a transversal pin or a spring-loaded longitudinal pin, depending on the way of removing the breech from the breech block. A disadvantage of these solutions is an increased number of parts in the assembly.

It is the object of the invention to propose such a design of the assembly of a breech, a breech block and an ejector that would not exhibit the above-mentioned drawbacks of the prior-art.

DISCLOSURE OF INVENTION

The said object is achieved through an assembly of a breech, a breech block and an ejector wherein the breech is connected to the breech block with the use of a groove, arranged in the breech block, and a corresponding recess, arranged in the breech, wherein an ejector is arranged in the breech that is longitudinally adjustable in a sliding way between the front and rear end position, and the ejector is biased by a spring against the shooting direction, and on the back of the ejector a recess is arranged that a peg that protrudes from the breech reaches into, according to the invention the principle of which is that at the rear side of the ejector, a longitudinal pin is arranged that fits into an opening in the breech block in the rear end position of the ejector, and on the part of the ejector that protrudes out of the breech, a stop surface is arranged for bearing on the breech guide that protrudes out of the breech block.

An advantage of the assembly according to the invention is a reduction of the number of parts as compared to prior-art designs since a structurally adapted ejector is used to lock the breech in the breech block.

BRIEF DESCRIPTION OF DRAWINGS

The invention will be described in more detail with reference to a particular embodiment of the assembly of a breech, a breech block and an ejector according to the invention, shown in attached drawings where individual figures represent.

DESCRIPTION OF PREFERRED EMBODIMENTS

Figure 1:
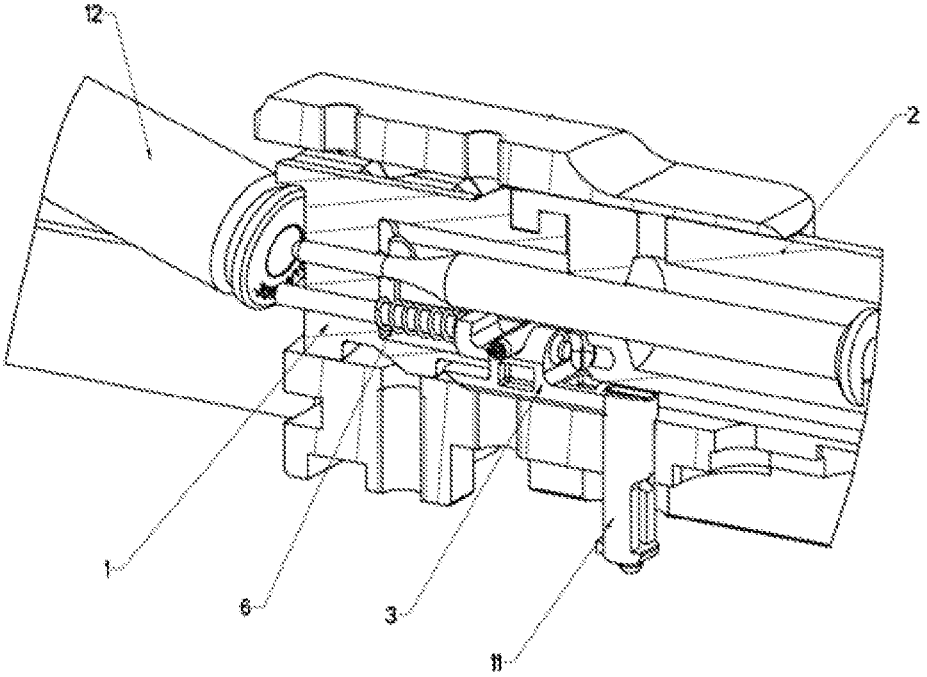
FIG. 1—a section of an assembly according to the invention at the moment of ejecting the cartridge case after the shot.
Figure 2:
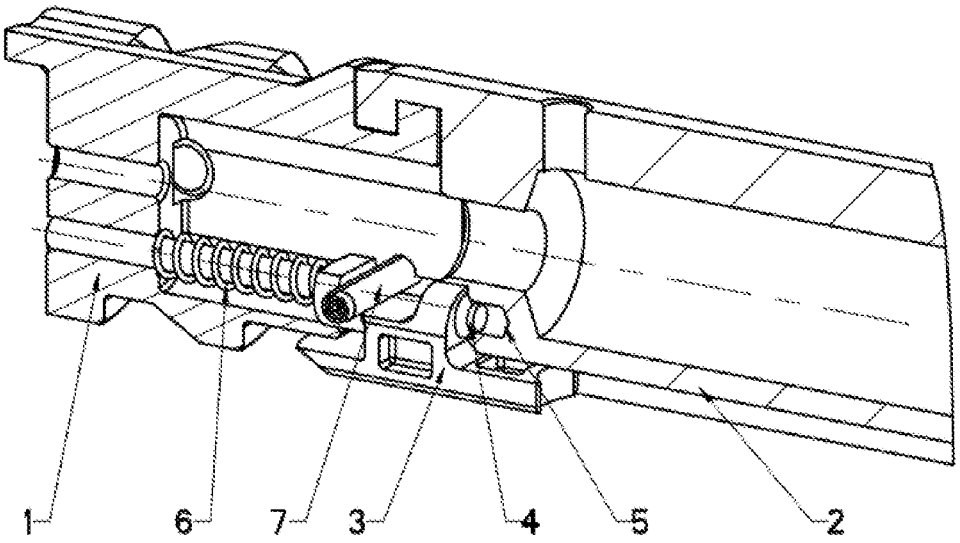
FIG. 2—a detailed view of the assembly of FIG. 1 with the breech locked in the breech block.
Figure 3:
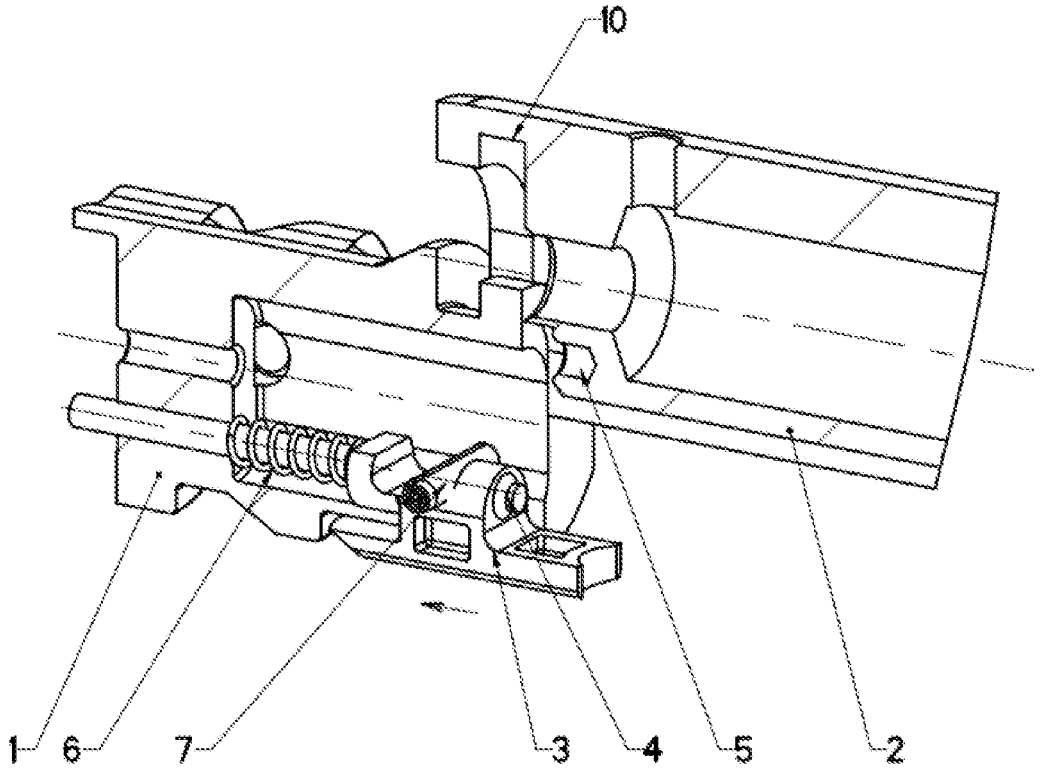
FIG. 3—the assembly of FIG. 2 at the moment of removing of the breech out of the breech block.
Figure 4:
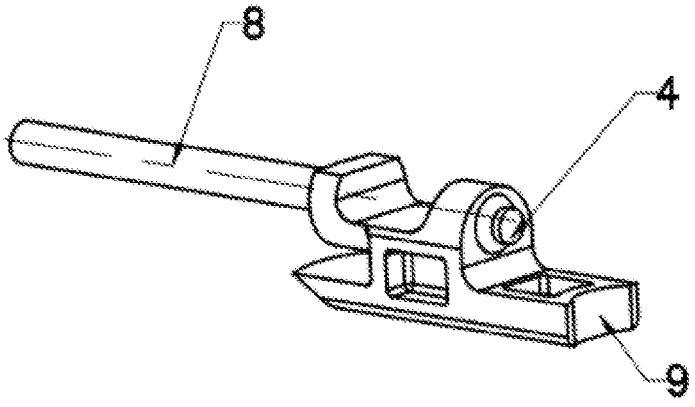
FIG. 4—a detail of the ejector.

The assembly of a breech head 1 (as used herein, "breech" and "breech head" are used interchangeably and are intended to mean the same thing and refer to the same element, the head of a breech block), a breech block 2 and an ejector 3 according to FIGS. 1, 2 and 3 shows a breech 1 that is connected to the breech block 2 with the use of a groove 10 arranged in the breech block 2, and a corresponding recess arranged in the breech 1.

In the breech 1, an ejector 3 is arranged that is slidably longitudinally adjustable in the direction of the breech 1 axis between the front and rear end position.

The ejector 3 is biased against the shooting direction by a spring 6, arranged along the perimeter of the shank 8 of the ejector 3. On the back of the ejector 3, a recess is arranged that a peg 7 that protrudes out of the breech 1 reaches into.

On the rear side of the ejector 3, a longitudinal pin 4 is arranged that, in the rear end position of the ejector 3, fits into an opening 5 in the breech block 2, and on the portion of the ejector 3 that protrudes out of the breech 1, a stop surface 9 is arranged for bearing on the breech guide 11 that protrudes out of the breech block 2.

The primary function of the ejector is to eject empty cartridge cases 12. The ejector 3 is biased by a spring 6, arranged along the perimeter of the ejector 3 shank 8. The spring 6 returns the ejector 3 after ejection of the cartridge case 12 (see FIG. 1) back to the original position so that the firearm can be prepared for the next charging of the firearm. The ejector 3 is fixed in the breech 1 with a peg 7. When the breech 1 assembly is pulled into the rear position, the ejector 3 will hit the breech 1 guide 11, which will stop the ejector 3, but the rest of the breech 1 assembly and the cartridge case 12 carried at the front of the breech 1 will continue moving for a short time. The shank 8 of the ejector 3 will act on the bottom of the cartridge case 12 and the cartridge case 12 will be ejected.

When the ejector 3 hits the guide 11 of the breech 1, both during the ejection of the cartridge case 12 or during common handling, the guide 11 of the breech 1 is exposed to stressing impacts. These impacts are partly attenuated by the spring 6 of the ejector 3, which makes the breech 1 guide 11 suffer from less stress.

The pin 4 on the ejector 3 fits into the opening 5 in the breech block 2, which locks the breech 1 against being removed (see FIG. 2). When the ejector 3 is moved with a finger of the hand or another object beyond the stop surface 9 in the shooting direction, the pin 4 is pushed out of the opening 5, which allows the breech 1 to be removed out of the groove 10 (see FIG. 3) during cleaning of the firearm or during the replacement of the breach 1 when the firearm is being converted to another gauge.

LIST OF REFERENCE SIGNS

1 breech
2 breech block
3 ejector
4 ejector pin
5 opening in the breech block
6 ejector spring
7 ejector peg
8 ejector shank
9 stop surface of the ejector
10 groove in the breech block
11 breech guide
12 cartridge case

The invention claimed is:

1. An assembly comprising a breech head, a breech block and an ejector, wherein the breech head is connected to the breech block with the use of a groove arranged in the breech block and a corresponding recess arranged in the breech head, wherein the ejector is arranged in the breech head and is longitudinally adjustable in a sliding way between a front position and a rear end position, wherein the ejector is biased by a spring against a shooting direction, wherein a recess is arranged on a back of the ejector, wherein a protruding peg from the breech head reaches into the recess, wherein a longitudinal pin is positioned at a rear side of the ejector that fits into an opening in the breech block in the rear end position of the ejector, wherein a stop surface is positioned on a portion of the ejector that protrudes out of the breech head, and wherein the stop surface is arranged for bearing on a breech block guide that protrudes out of the breech block.

* * * * *